United States Patent [19]

Hill et al.

[11] 4,065,183

[45] Dec. 27, 1977

[54] RECOVERY SYSTEM FOR OIL SHALE DEPOSITS

[75] Inventors: David A. Hill, Hermosa Beach; Durk J. Pearson, Palos Verdes Estates; Ethelyn P. Motley, Rancho Palos Verdes, all of Calif.; Thomas N. Beard, Denver, Colo.; James L. Farrell, Palos Verdes Estates, Calif.

[73] Assignee: TRW Inc., Redondo Beach, Calif.

[21] Appl. No.: 741,817

[22] Filed: Nov. 15, 1976

[51] Int. Cl.[2] ..... E21C 41/10

[52] U.S. Cl. ..... 299/4; 166/259; 166/303

[58] Field of Search ..... 299/2, 4, 5; 166/259

[56] References Cited

U.S. PATENT DOCUMENTS

| | | | |
|---|---|---|---|
| 3,502,372 | 3/1970 | Prats | 299/5 |
| 3,586,377 | 6/1971 | Ellington | 299/2 |
| 3,753,594 | 8/1973 | Beard | 299/4 |
| 3,759,328 | 9/1973 | Ueber et al. | 299/4 |
| 3,759,574 | 9/1973 | Beard | 299/4 |
| 3,779,601 | 12/1973 | Beard | 299/4 |
| 3,945,679 | 3/1976 | Closmann | 299/5 |
| 3,957,306 | 5/1976 | Closmann | 299/4 |

*Primary Examiner*—Ernest R. Purser
*Attorney, Agent, or Firm*—John J. Connors; Benjamin DeWitt; Donald R. Nyhagen

[57] ABSTRACT

A process for the in-situ recovery of hydrocarbon, carbon monoxide, and hydrogen values and associated minerals from subsurface oil shale deposits is provided by forming a gas-tight retort chamber and injecting it with a hot, pressurized gas followed by a solvent extraction and finally a combustion of the hydrocarbon residue. In order to conduct the process, the shale formation must be beneath a gas impermeable geological structure which will form a gas-tight chamber upon leaching of the water soluble minerals.

16 Claims, 3 Drawing Figures

RECOVERY SYSTEM FOR OIL SHALE DEPOSITS

BACKGROUND OF THE INVENTION

In the past, oil shale deposits were mined and brought to the surface for further processing of the various components and constituents. This process was expensive, time-consuming, and dangerous. If the oil shale deposits were mined by open pit, their removal was time-consuming and expensive. Additional ecological problems render this method of extraction undesirable today.

A somewhat more dangerous approach involves underground tunneling into the shale oil deposits in a predetermined pattern for the purpose of blasting and rubblizing the oil shale deposit. After the deposit is rubblized, a flame front is instituted which causes an in-situ retorting of the hydrocarbon values in the shale. This process has met with varying success primarily because of difficulty of obtaining uniform rubble in the shale deposit with the attending problems of maintaining a reasonably uniform flame front and plastic flow of the rock material. If the rubble is not reasonably uniform, a substantially uniform flame front is not maintained and the retort flames are quenched by the retorting products, or by-pass burning occurs.

SUMMARY OF THE INVENTION

The present invention relates to an in-place process for extracting water soluble minerals to develop the porosity and permeability in oil shale, generating and recovering oil from the artificially leached chamber, and the subsequent leaching of water insoluble minerals. This process is most applicable to oil shale deposits lying beneath gas-tight geological formations. To effect the process, at least one hole is drilled through the gas-tight structure into the shale deposit. Hot water, preferably steam, is pumped into the shale formation dissolving water soluble minerals which are removed to the surface. Removal of the water soluble materials render the oil shale porous and permeable to hot gases which change the kerogen to bitumen which then decompose into oil, gas, and tarry residue. Simultaneously with the decomposition of the kerogen, is the decomposition of certain other water insoluble minerals, e.g. dawsonite. In the penultimate step, the retort chamber is flushed with a solvent-surfactant to recover the hydrocarbon values and the decomposed minerals values. A tertiary hydrocarbon recovery comprises the final step in which pyrolysis of the residue produces a low B.t.u. gas from the residual hydrocarbon values.

When processing of the retort chamber is complete, the pipes are severed at the next level to form another gas-tight retort chamber. The process is repeated until substantially all of the oil shale deposit is worked.

DESCRIPTION OF THE PREFERRED EMBODIMENTS

Figure 1:
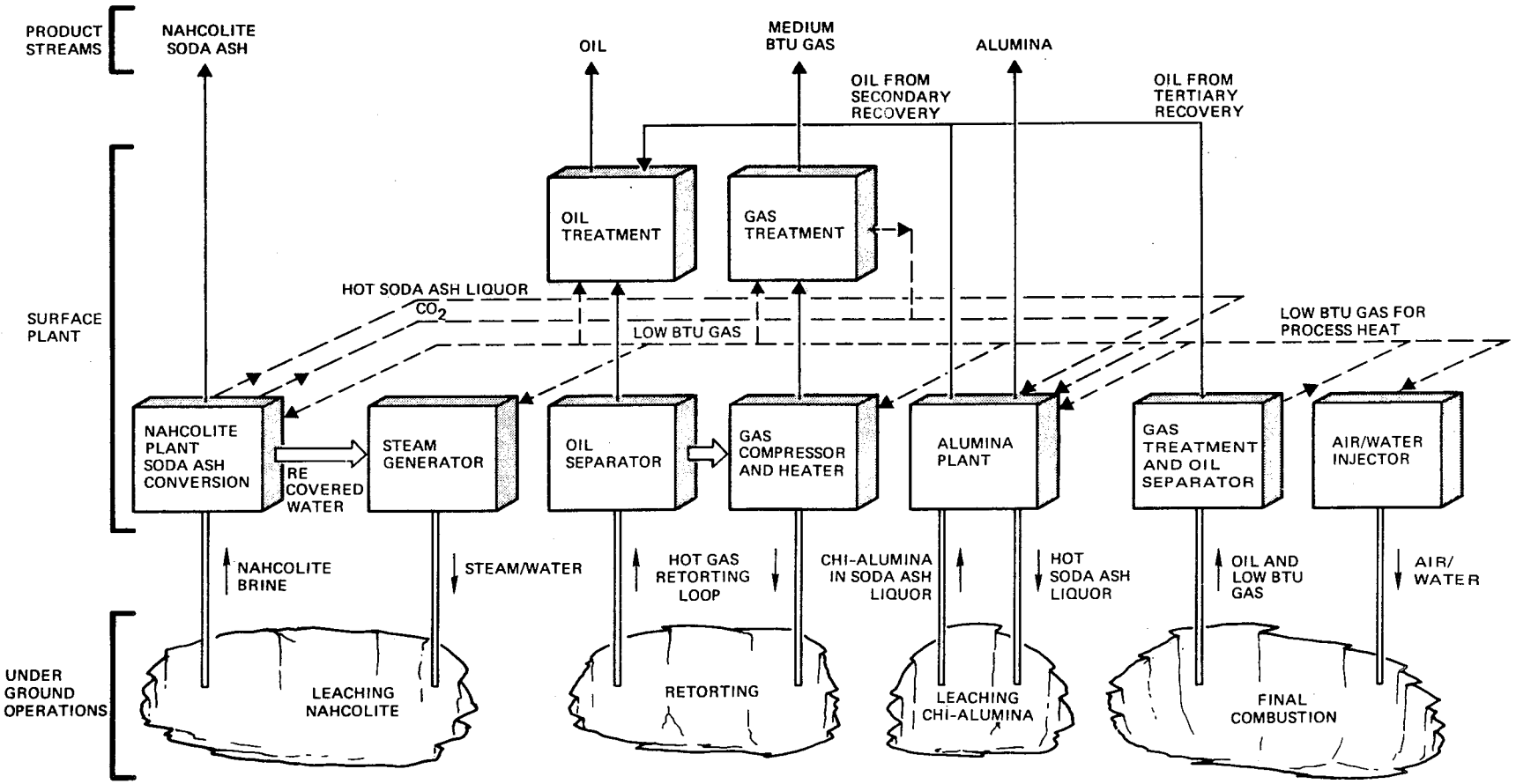
FIG. 1 shows a process diagram for the integrated in-place recovery of shale oil and associated minerals from deposits lying beneath gas-tight subsurface formations.

The present process is directed to the recovery of minerals, such as nahcolite, dawsonite, nordstrandite, shortite, trona, and halite, and hydrocarbon, carbon monoxide, and hydrogen values from subsurface formations which have a gas-tight overburden. One particular area which meets these requirements is the northcentral part of the Piceance Creek Basin in northwestern Colorado. This area contains recoverable oil shale, nahcolite, and dawsonite spread over an area of about 300 square miles and approximately 900-feet in thickness. Estimates of the in-place resources of the nahcolite-bearing interval are approximately 135 billion barrels of shale oil, 30 billion tons of nahcolite, and 10 billion tons of dawsonite. By employing an integrated in-place process, as shown in FIG. 1, the nahcolite is first extracted followed by shale oil recovery, alumina recovery, and tertiary fossile fuel recovery. In order for all of the mineral and hydrocarbon values to be recovered, the process must be conducted in a sequence of specific steps.

Figure 2:
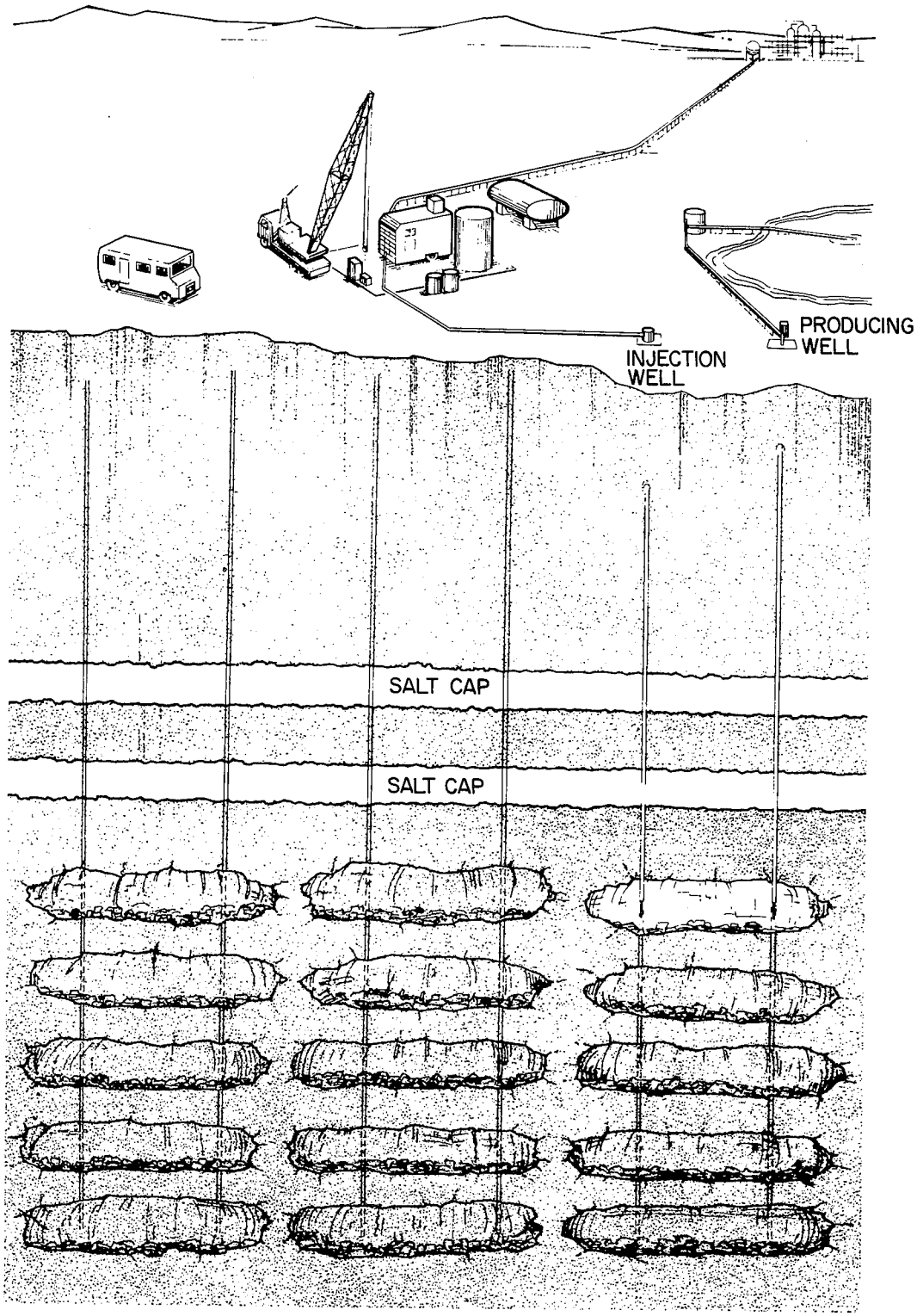
FIG. 2 shows the vertical mining pattern of the gas-tight retort chambers.

In the first step, as shown in FIG. 2, an oversized hole is drilled into the gas-tight overburden which is then cased and grouted to preserve the integrity of the overburden. In the Piceance Creek Basin, halite caps separate the aquifers above the cap from the oil shale below the caps. This halite dome is ductile or plastic so that if pressures build up under the dome the layer will give without fracturing. Thus, the dome provides a gas impervious and water resistant separation between the aquifers and the oil shale.

There are essentially two well patterns which may be drilled. Where individual well patterns appear to be the most suitable approach, a coaxial pipe is placed down the well hole and fluids are injected into the hole through the outer pipe while products are extracted through the center pipe. Individual wells can be monitored and throttled in order to control the advance of the process front. A disadvantage with the individual well is that occasionally severe channeling may occur between the injection and the production ports. This channeling could effectively short-circuit the leaching and retorting process.

A substantially improved control of the rate and geometry of the leach and retorting process may be obtained through a multi-well pattern. While multi-well patterns may take numerous configurations, two configurations appear to be the more promising. In one configuration, a central injector well is placed in the center of a ring of producer wells equally spaced on a circle around the central injector well. In an alternative arrangement, injector wells are sunk in a row and producers wells are sunk in a separate row equidistant from the injector wells. In a multi-well pattern, detection of an excessively open channel between any pair of wells would be more easily accomplished, and the producer well could be shut off or sealant injected so as to avoid the open channel without abandoning the entire pattern. This compartmentalizing feature would not be available in a single or dual well configuration. In addition, the energy efficiency of leaching and retorting would be higher in the multi-well configuration as opposed to the single well arrangement.

In the Piceance Creek Basin, solution mining of nahcolite is required to provide in-place access to the balance of the resource. Nahcolite is soluble in water and is decomposed by heat into sodium carbonate, carbon dioxide, and water. Although the nahcolite occurs as nodules, beds, or disseminated crystals, these tend to be interconnected. To accomplish nahcolite removal from the selected subsurface horizon, hot water, or preferably steam, under pressure is injected into the formation at the top of a completed borehole. Fracturing mechanisms, such as hydrofracturing, explosive charges, pressure pulsing, or thermal cycling may be employed to assist the leach process. Rapid heating of nahcolite crystals and the oil shale produces spalling and fragmentation which aids nahcolite extraction. When the leach liquor reaches the bottom of the planned chamber, it may be returned to the surface for recovery of sodium salts, such as soda ash. Reduction of pressure on the liquor at the surface must be controlled to prevent flashing of water vapor and the resulting carbonate crystallization in the production piping. Solution removal permits admission of fresh steam at the top of the chamber, attacking the fresh nahcolite and gradually raising the temperature of the residual rock. The end-product of nahcolite removal is a chamber full of heated and permeable or rubblized oil shale with an estimated 20 percent interconnected void space.

After creating porosity in the formation by leaching the water-soluble nahcolite from the shale zone, the chamber is pumped dry and in-situ retorting of the oil shale can be accomplished by the circulation of a hot fluid, such as heated natural gas or heated retort off-gas from the injection well through the permeable shale bed and out the producing well. During the retorting process, heat is transferred from the hot fluid to the shale, causing the kerogen and dawsonite to decompose according to the following idealized reactions.

$$\text{Kerogen} \rightarrow \text{bitumen} \rightarrow \text{oil} + \text{gas} + \text{residue} \quad (1)$$

$$2NaAl(OH)_2CO_3 \rightarrow Na_2CO_3 + A1_2O_3 + 2H_2O + CO_2 \quad (2)$$

$$NaAl(OH)_2CO_3 \rightarrow NaAlO_2 + CO_2 + H_2O \quad (3)$$

Neither reaction (2) nor (3) represents the sole mechanism for dawsonite decomposition, although it is known that reaction (3) is the predominant one at the higher temperatures and reaction (2) is almost non-existent at temperatures above 650° F.

The in-situ retorting process should be carried out in the temperature range of 660° to 930° F, and preferably between 800° and 850° F. These temperature ranges will permit rapid completion of the oil evolution from the raw shale, and the decomposition of dawsonite to chi-alumina which occurs about 660° F. In addition, co-occurring with the dawsonite is the nordstrandite which forms gamma-alumina at temperatures above 930° F. The retorting of oil shale at temperatures in the range of 800° to 850° F leads to a quality shale oil product with a typical pour point about 25° F, and API gravity of about 28° and a nitrogen content of less than 0.8 weight percent according to Hill and Dougan in *The Characteristics of a Low-Temperature In-Situ Shale Oil,* Quarterly of the Colorado School of Mines, Volume 62, No. 3, July, 1967. In contrast, the shale oil from high temperature retorting can have a pour point of as high as 90° F and API gravity of about 20° and a nitrogen content of approximately 2 weight percent. Thus, the shale oil product from the low-temperature process may be readily transported to refineries by a pipe line, and on-site upgrading becomes optional.

Pressures for the in-situ retorting process will depend upon the permeability of the shale bed, the height of the overburden, and the heat capacity and circulation rate of the hot fluid. A higher pressure minimizes the volume of recirculating hot fluid required, but this could lead to a considerable drop in the yield of shale oil according to Bae, *Some Effects of Pressure in Oil Shale Retorting,* Society Petroleum Engineers Journal, No. 9, page 243.

Oil vapor from the decomposition of kerogen is cooled by the formation ahead of the retorting front and condenses and drains into a pocket from which it can be pumped along with some water from dawsonite decomposition. The off-gas produced by the kerogen in the retorting process includes four components comprising the hot fluid used for retorting, the gas from the kerogen decomposition, oil vapors, and the carbon dioxide and water vapor from the dawsonite decomposition. If the gas from kerogen decomposition is used as the heat carried for retorting, the resulting off-gas will have a medium heating value after the removal of the water.

In the retorting of each shale chamber, the recirculating fluid has only to be externally heated during the first part of the retorting period. After approximately half of the shale bed chamber has been retorted, cooler fluid can be injected into the formation and heated by the hot, retorted shale bed. Thus, waste heat can be recovered from the first half of the retorted shale bed and used for retorting of the remaining portion of the shale bed.

After the retorting step has been completed, alumina which was formed from dawsonite and nordstrandite can be extracted. This light base extractable alumina which was created when the oil shale was retorted at moderate temperatures, was formed by dawsonite when it was heated to 350° C according to the following reaction as reported by Smith and Young in *Dawsonite: Its Geochemistry, Thermal Behavior, and Extraction from Green River Oil Shale,* paper presented at the Eighth Oil Shale Symposium, Colorado School of Mines, Golden, Colorado, Apr. 17–18, 1975:

$$2NaAl(OH)_2CO_3 \rightarrow Na_2CO_3 + Al_2O_3 + 2H_2O + CO_2 \quad (2)$$

This alumina which includes values from nordstrandite, can be extracted from the retorted oil shale by solution of 1N sodium carbonate and a nonionic or suitable anionic surfactant such as:

alkanol amines
alkanol amides
polyoxyalkylene oxide block copolymers
carboxylic amides
carboxylic esters
ethoxylated aliphatic alcohols
ethoxylated alkylphenols
polyoxyethylenes
alkyl sulfates
N-acyl-N-alkyltaurates
naphthalene sulfonates
alkyl benzene sulfonates
alkane sulfonates
alkanol amide sulfates
sulfated alkylphenols
phosphate esters The solution equation is represented as:

$$Al_2O_3 + 2CO_3^{=} + H_2O \rightarrow 2HCO_3^{-} + 2AlO_2^{-} \quad (4)$$

As this leach liquor fills the cavity, it creates a water drive to mobilize unrecovered shale oil and float it to the top of the cavity. This oil and pregnant solution can then be removed to the surface. The surfactant(s) facilitate the mobilization of some remaining oil, as in secondary recovery operations, and helps assure contact of the chi-alumina by the light base solution.

Figure 3:
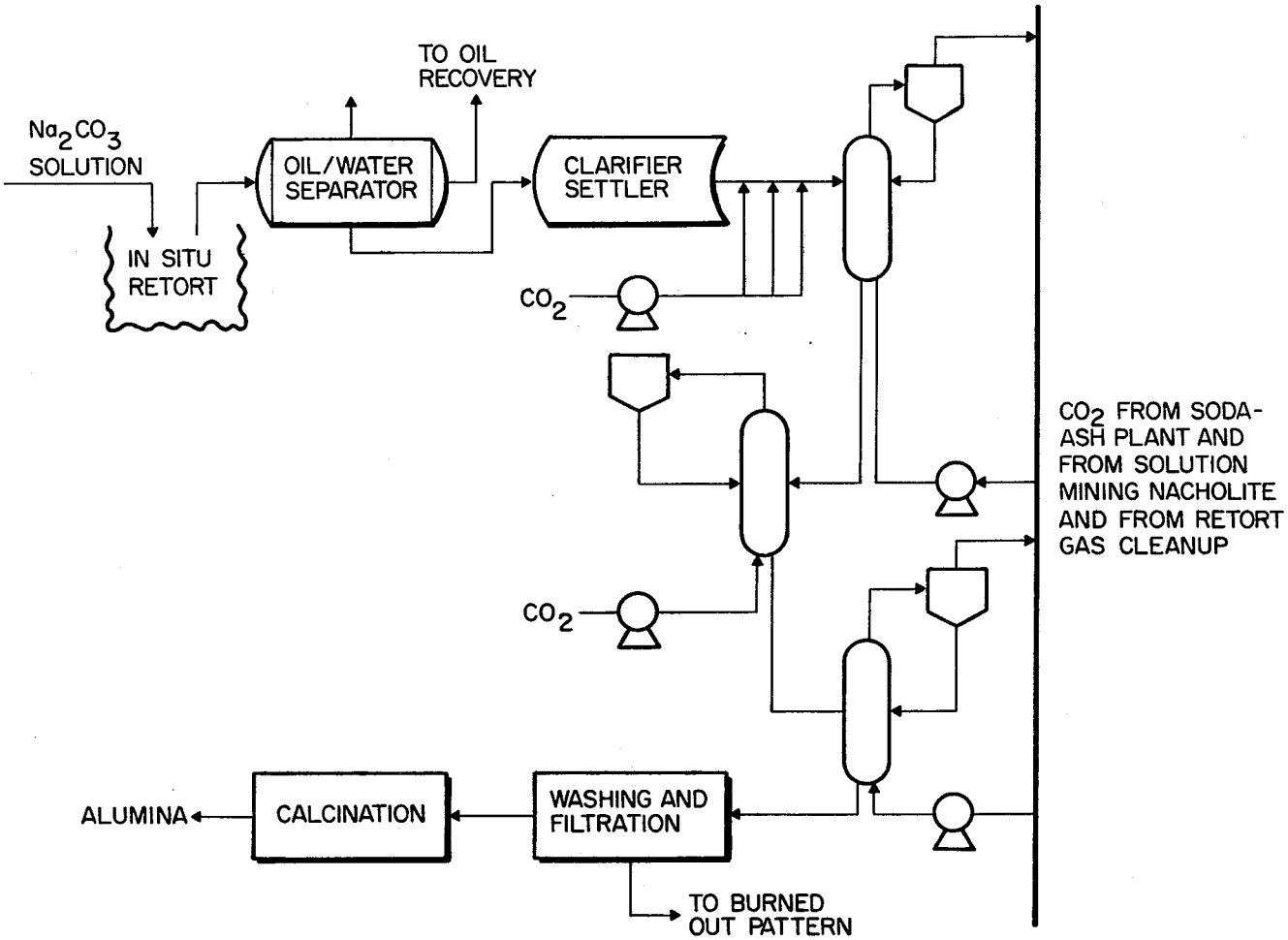
FIG. 3 shows the general flow diagram for the alumina recovery facility which can be used in conjunction with the in-place recovery process.

The alumina recovery facility, as shown in FIG. 3, first transports the recovered liquids to a liquid/liquid separator. The oil then goes to the oil recovery plant, and the aqueous solution is then sent to a clarifier to remove shale fines. Subsequently, the liquid is passed through a series of carbon dioxide bubblers where the solution pH is progressively lowered from 11 to 9 causing the alumina to precipitate from solution. The solid is then washed, filtered, and calcined to produce alumina.

Even with good yields from the primary and secondary recovery processes, residual fuel value will remain in the retort bed in the form of unmobilized oil and carbonaceous residue. Although this residue has little commercial value, it may yield sufficient fuel value to supply heat for the production of steam for the leach phase and the heating of retorting gas for hot gas retorting in another chamber. In view of this, a tertiary recovery step is effected which comprises removing water of the previous step from the retort chamber and instituting a flame front to combust the residue. After combustion of the residue has begun, water vapor is injected down the well hole. The water vapor reacts with the residue to hydrogenate the remaining hydrocarbon values so that cross-linking polymerization of unsaturates does not occur. By preventing polymerization of the hydrocarbon values during pyrolysis, the rubble bed remains porous which permits the hydrocarbon values to be driven off in advance of the flame front.

In addition to liquid and gaseous hydrocarbons, carbon monoxide and hydrogen are produced in this stage. These can be used as a process fuel source and as feedstocks to a methanator to produce saleable methane.

When all practical hydrocarbon and mineral values have been removed from the retort chamber, the chamber is back-filled with water, solutions, or slurries to prevent subsidence. Aqueous solutions suitable for this purpose may comprise some of the excess minerals which were removed in some of the previous recovery processes. Thus, if more sodium bicarbonate is being removed than can be disposed of economically, the solutions or slurries of these materials may be pumped back into the ground for storage and later removal. Subsidence must be controlled to prevent process interruption and to minimize environmental damage. The vertical component of the stress field is governed by unit weight of the rock and the vertical depth to the opening. The reaction to this stress and size of the opening which can be tolerated without collapse will be governed by the strength of the rock immediately above the opening.

To minimize subsidence, extraction operations must leave pillars of undisturbed shale to support the overburden. This technique is commonly used in room and pillar mining. Thus, to reduce the possibility of subsidence which follows an initial roof collapse that causes stress and disruption of strata all the way to the earth's surface, back-filling with pressurized water or aqueous solutions or slurries should be considered.

After the chamber has been back-filled, the pipe may be plugged to seal the chamber. When the next level of mining has been determined, the pipe is perforated at that level and the process is repeated. FIG. 2 shows on arrangement of multiple chamber mining.

Each step of the process is integrated and interdependent upon obtaining the inputs of process fuels, chemicals, or working fluids which are supplied as outputs by some other previous stage. Thus, it would be impractical to pump large quantities of a basic surfactant solution into a borehole to recover alumina values unless the chamber had been leached and retorted previously. Likewise, recovery of hydrocarbon values from the oil shale would be difficult and expensive unless the chamber was first made porous and permeable by the nahcolite leach. Therefore, in order to carry out the process in a logical and economic manner, the process steps must be followed in the sequence set forth previously.

Although there may be numerous modifications and alternatives apparent to those skilled in the art, it is intended that the minor deviations from the spirit of the invention be included within the scope of the appended claims, and that these claims recite the only limitations to be applied to the present invention.

We claim:

1. A process for the in-situ recovery of hydrocarbon values and associated minerals from subsurface oil shale deposits in which a gas-tight retort chamber can be produced comprising the steps of:
   A. drilling into said oil shale deposits;
   B. injecting heated water into said shale deposits to dissolve and extract said associated minerals which are water soluble thereby forming a substantially gas-tight chamber;
   C. injecting hot, pressurized gas into said shale deposit in said chamber whereby said associated minerals are decomposed and hydrocarbon fluids extracted;
   D. injecting a solvent-surfactant into said deposit and extracting said decomposed minerals and hydrocarbon fluids;
   E. removing said solvent-surfactant from said deposit;
   F. instituting a flame front to combust hydrocarbon and carbonaceous residue; and
   G. filling said chamber with a fluid selected from the group consisting of water, aqueous solutions, and aqueous slurries.

2. A process according to claim 1 wherein said shale deposit is beneath a layered salt deposit.

3. A process according to claim 1 wherein said associated minerals are selected from the group consisting of nahcolite, dawsonite, nordstrandite, shortite, trona, and halite.

4. A process according to claim 1 wherein said heated water is steam.

5. A process according to claim 1 wherein said water soluble mineral is selected from the group consisting of halite, trona, and nahcolite.

6. A process according to claim 1 wherein said hot, pressurized gas is selected from the group consisting of low molecular weight hydrocarbon gas, carbon dioxide, carbon monoxide, hydrogen, nitrogen, steam, and mixtures thereof.

7. A process according to claim 1 wherein said solvent-surfactant is an aqueous solution of a compound selected from the group consisting of sodium carbonate and sodium bicarbonate and a nonionic surfactant selected from the group consisting of alkanol amines and alkanol amides.

8. A process according to claim 1 wherein said decomposed minerals produce chi-alumina.

9. A process for the in-situ recovery of hydrocarbon values and associated minerals from subsurface oil shale deposits in which a gas-tight retort chamber can be produced comprising the steps of:

A. drilling at least one hole into the bottom of said shale deposit;

B. inserting piping to the bottom of said hole;

C. pumping heated water down an injection pipe into said shale formation and extracting water soluble associated minerals from a producer pipe thereby forming a substantially gas-tight chamber;

D. injecting hot, pressurized gas down said injection pipe into said shale deposit whereby said associated minerals are decomposed by heat and hydrocarbon fluids are extracted from said producer pipe;

E. injecting a mixture comprising a surfactant and a portion of said water soluble mineral values previously obtained down said injection pipe and extracting said decomposed minerals and hydrocarbon fluids from said producing well;

F. clearing said chamber;

G. instituting a flame front to combust hydrocarbon and carbonaceous residue and extracting hydrocarbon values from said producer pipe for process heating;

H. filling said chamber with aqueous solution or slurry; and

I. raising the termination of said injector pipe and said producer pipe a predetermined distance to begin the formation of the next gas-tight chamber in said shale deposit.

10. A process according to claim 9 wherein said shale deposit is beneath a layered salt deposit.

11. A process according to claim 9 wherein said associated minerals are selected from the group consisting of nahcolite, dawsonite, nordstrandite, shortite, trona, and halite.

12. A process according to claim 9 wherein said heated water is steam.

13. A process according to claim 9 wherein said water soluble mineral is selected from the group consisting of halite, trona, and nahcolite.

14. A process according to claim 9 wherein said hot, pressurized gas is selected from the group consisting of low molecular weight hydrocarbon gas, carbon dioxide, carbon monoxide, hydrogen, nitrogen, steam, and mixtures thereof.

15. A process according to claim 9 wherein said mixture is an aqueous solution of a compound selected from the group consisting of sodium carbonate and sodium bicarbonate and a nonionic surfactant selected from the group consisting of alkanol amines and alkanol amides.

16. A process according to claim 9 wherein said decomposed minerals form chi-alumina.

* * * * *